US006647879B1

(12) United States Patent
Papadopoulos et al.

(10) Patent No.: US 6,647,879 B1
(45) Date of Patent: Nov. 18, 2003

(54) BRIDGE SLEEVE FOR PRINTING APPARATUS

(75) Inventors: Jeremy James Michael Papadopoulos, Green Bay, WI (US); Robert W. Braun, Appleton, WI (US); Joseph R. Bero, Green Bay, WI (US)

(73) Assignee: Paper Converting Machine Co., Green Bay, WI (US)

( * ) Notice: Subject to any disclaimer, the term of this patent is extended or adjusted under 35 U.S.C. 154(b) by 0 days.

(21) Appl. No.: 10/329,588

(22) Filed: Dec. 26, 2002

(51) Int. Cl.[7] ..... B41F 13/10

(52) U.S. Cl. ..... 101/376; 101/375; 101/329; 101/479; 428/36.9; 492/38; 492/28; 279/32; 279/5; 279/6

(58) Field of Search ..... 101/375, 376, 101/329, 479; 428/36.9; 492/38, 28; 279/32, 5, 6

(56) References Cited

U.S. PATENT DOCUMENTS

| | | | | |
|---|---|---|---|---|
| 4,028,783 A | | 6/1977 | Buck | |
| 4,360,208 A | | 11/1982 | Hill et al. | |
| 4,583,460 A | | 4/1986 | Maslin et al. | |
| 4,850,779 A | | 7/1989 | Cashell et al. | |
| 4,890,849 A | | 1/1990 | Eason | |
| 5,036,766 A | * | 8/1991 | Songer | 101/375 |
| 5,499,780 A | | 3/1996 | Gensheimer | |
| 5,706,731 A | | 1/1998 | Francille et al. | |
| 5,735,206 A | | 4/1998 | Rossini | |
| 5,782,181 A | | 7/1998 | Rossini | |
| 5,819,657 A | | 10/1998 | Rossini | |
| 5,840,386 A | | 11/1998 | Hatch et al. | |
| 6,250,223 B1 | * | 6/2001 | Dufour | 101/375 |
| 6,276,271 B1 | | 8/2001 | Busshoff | |
| 6,357,354 B1 | * | 3/2002 | Dauer et al. | 101/477 |
| 6,386,103 B1 | * | 5/2002 | Charette et al. | 101/375 |
| 6,457,624 B1 | | 10/2002 | Weihrauch | |
| 6,523,470 B2 | | 2/2003 | Kolbe et al. | |
| 2002/0041471 A1 | | 4/2002 | Koyama | |
| 2002/0046668 A1 | | 4/2002 | Bell et al. | |

FOREIGN PATENT DOCUMENTS

| | | |
|---|---|---|
| EP | 0018370 | 3/1982 |
| EP | 0127953 B1 | 5/1984 |
| EP | 0191648 B1 | 2/1986 |
| EP | 0125896 B1 | 11/1988 |
| EP | 0527293 A1 | 2/1993 |
| EP | 0732201 B1 | 1/1999 |
| EP | 0711665 B1 | 3/1999 |
| EP | 0791477 B1 | 6/2001 |
| EP | 1164911 A2 | 12/2001 |
| EP | 1035950 B1 | 1/2002 |
| EP | 1104347 B1 | 11/2002 |
| WO | 98/29259 A1 | 1/1997 |
| WO | 99/29472 | 11/1998 |
| WO | 00/10809 | 8/1999 |
| WO | 01/70505 A2 | 2/2001 |
| WO | 01/30574 A1 | 3/2001 |

OTHER PUBLICATIONS

Rotec Catalog (date: Unknown).
AXCTL Catalog (date: Unknown).
Produt Overview—Version 5/2000 (date: Unknown).

* cited by examiner

*Primary Examiner*—Andrew H. Hirshfeld
*Assistant Examiner*—Andrea Hence Evans

(57) ABSTRACT

A sleeve is provided with a clamp for removably clamping the sleeve on a mandrel. A rigid ring is mounted inside of the sleeve at each end of the sleeve. Each ring has a generally cylindrical inside surface which includes a curved contact portion which extends for less than 180 degrees and which is engageable with the outside surface of the mandrel. A curved clamp arm is pivotally secured at one end thereof to each ring. An eccentric shaft extends through an opening in the other end of the clamp arm. Rotation of the eccentric shaft moves the clamp arm toward the contact portion of the ring so that the mandrel can be clamped between the clamp arm and the contact portion.

11 Claims, 10 Drawing Sheets

BRIDGE SLEEVE FOR PRINTING APPARATUS

BACKGROUND

This invention relates to mounting a sleeve on a central locating member by applying a preload to the locating member. The invention is advantageously used with bridge sleeves which are commonly used between a mandrel of a printing press and a print sleeve. More particularly, the invention relates to a clamping mechanism for mechanically clamping the bridge sleeve on a mandrel.

Although the invention will be explained in conjunction with a mandrel of a printing press, the invention is not limited to printing applications.

In printing machinery, the printing press often has a rotatable mandrel for carrying a cylindrical printing sleeve with the printing plate mounted to it. The press mandrel has a fixed diameter and is permanently mounted in the press. As the print repeat changes for various print jobs, the printing sleeve will have a changing wall thickness, sometimes becoming excessively thick. Thick print sleeve walls add undesirable handling weight and can be a source of loss of print system rigidity and printed image accuracy.

In order to overcome this problem, a cylindrical bridge sleeve has been added to some systems to bridge the annular gap between the fixed diameter press mandrel and the variable size print sleeve. The print sleeves have an oversized inside diameter to mate with the outside diameter of the bridge sleeve. The bridge sleeve is the topic of this patent.

In the present art, bridge sleeves are clamped to mandrels by compressing a sleeve liner on the mandrel, a tapered collet, or a split clamp collar. However, this art suffers from various problems. Compressing the print sleeve liner requires some kind of external energy supply, like pneumatic or hydraulic pressure, to either force the sleeve into contact with the mandrel or to release a prestressed sleeve liner from the mandrel. In some current implementations, a locking pin and notch is required on press mandrels, bridge sleeves, and print sleeves. These add expense, are prone to cause damage to sleeves, and do not provide sufficient radial rigidity to the bridge sleeve.

Tapered collets are hard to design and do not hold good concentricity between the print sleeve and the press mandrel.

Split clamps are inherently not concentric and usually require external tools and access to both ends of the sleeve.

All of the conventional designs are hard to assemble because they require close assembly clearance between the mandrel and the sleeve. They all have features that make them difficult to use. They demand special consideration in the press design, like hydraulic or pneumatic piping and controls, and/or they do not rigidly attach the sleeve to the mandrel concentrically.

SUMMARY OF THE INVENTION

To solve the foregoing problems, we invented a mechanical clamp system with a new approach to attaching the bridge sleeve to the mandrel. The mechanical clamp system does not use any of the standard approaches and requires no external tools or controls.

The invention uses the mechanical advantage of a small eccentric and the rigidity of a solid ring to clamp the bridge sleeve to the mandrel rigidly and concentrically up to the designed maximum external load when used with a close tolerance mandrel. All clamp actions can be actuated with a short finger lever on one end of the sleeve. When the clamp is released, the clearance between the sleeve and the mandrel is much greater than in standard designs in order to facilitate easy assembly of the sleeve on the mandrel.

A rigid ring is mounted inside each end of the bridge sleeve. The bores of the rigid rings have raised or radially inwardly extending fixed, accurate contact areas on one side designed to contact the mandrel. The contact area wraps less than 180 degrees around the mandrel. A clamp arm is mounted on each ring with a pivot on one end of the arm and an eccentric shaft extending through the other end. A raised or radially inwardly extending contact on the clamp arm is opposite the raised area on the ring. All raised areas and the eccentric are sized to conform the raised areas to the mandrel when the eccentric is in one extreme of travel and to provide a generous assembly clearance around the mandrel when the eccentric is in the other extreme of travel. The clamp arm is designed to have a narrow range of known spring rates when compressed against the mandrel by the eccentric. The forces on the clamp arm from the interference caused by the eccentric will be greater than all external loads on the bridge sleeve when the eccentric is moved to the point of maximum interference or just off from that point. Any other method of applying a controlled preload will also work. If the eccentric is rotatable slightly beyond the point of maximum interference, the eccentric is provided with an over center self-locking design. The design can include a cross shaft which connects the eccentric on one end of the bridge sleeve to the eccentric on the other end of the sleeve. In this way, both ends of the clamp mechanism can be actuated simultaneously while the user accesses only one end.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
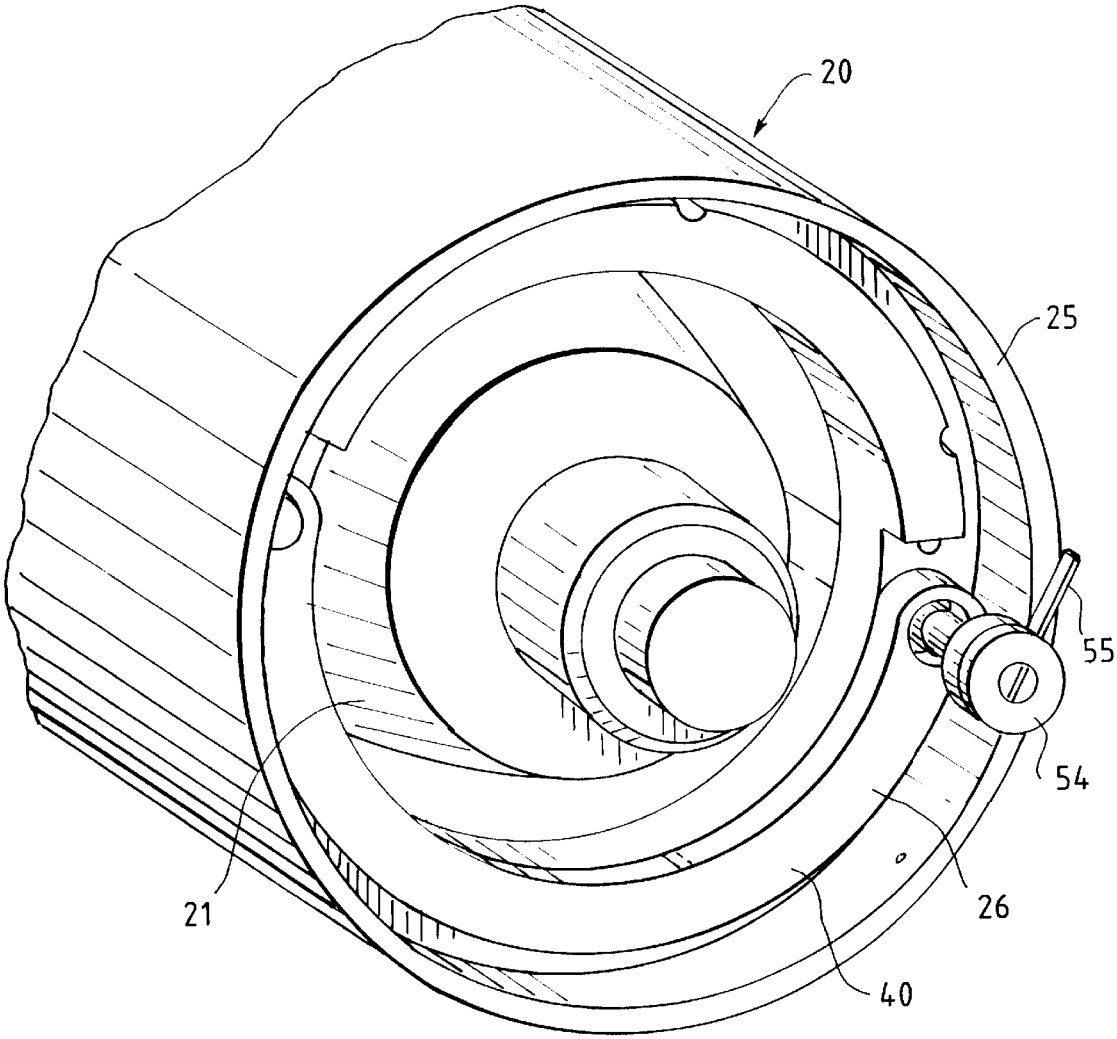
FIG. 1 is a fragmentary perspective view showing a bridge sleeve assembly formed in accordance with the invention being inserted over the end of a mandrel.

FIG. 1 illustrates a bridge sleeve assembly 20 being inserted over a mandrel 21. The mandrel 21 is typically a rotatable mandrel of a printing press, for example, a flexographic printing press. Such mandrels are well known and the details thereof need not be described herein. However, the concentric clamp mechanism can also be used on other types of mandrels or supporting structures.

Figure 2:
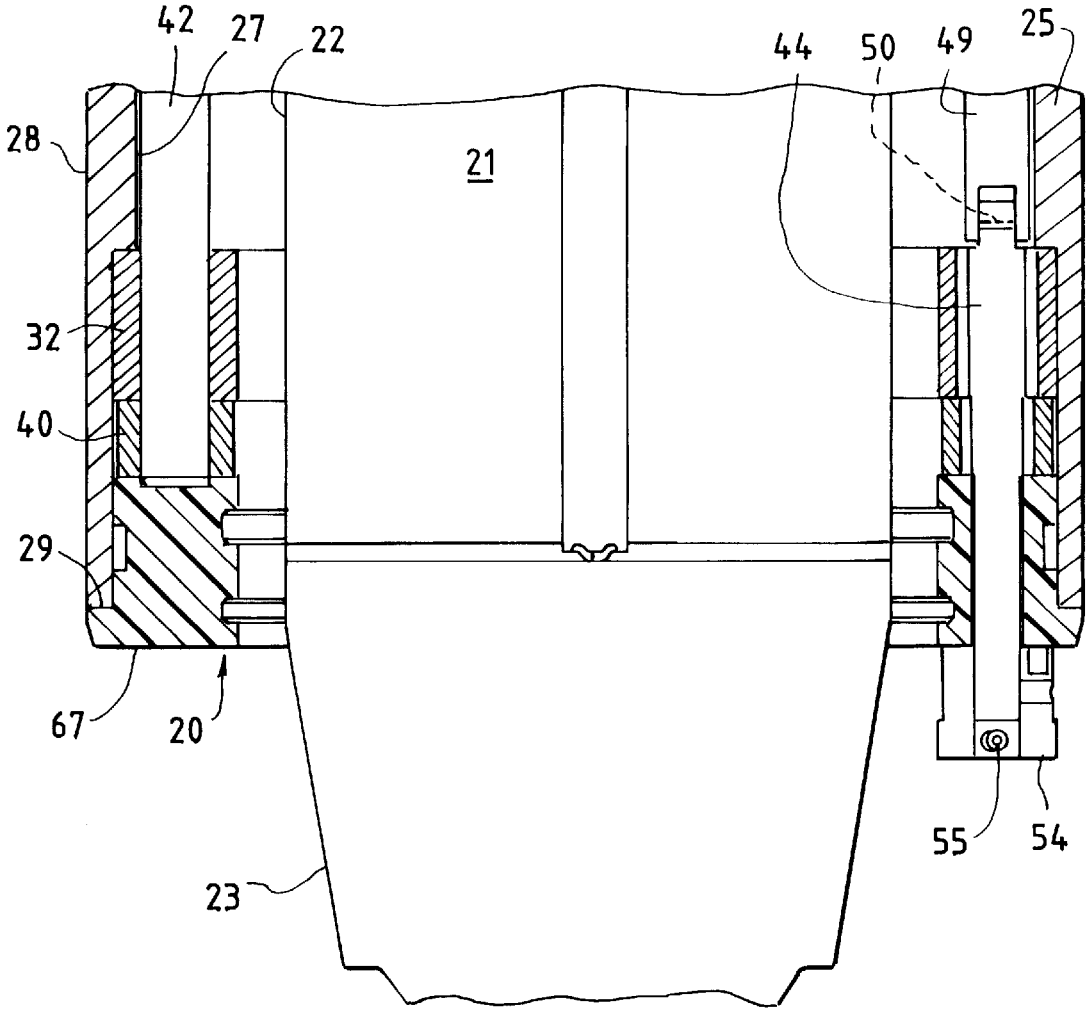
FIG. 2 is a fragmentary sectional view showing the bridge sleeve assembly mounted on the mandrel.

FIG. 2 illustrates the bridge sleeve assembly 20 mounted on a cylindrical portion 22 of the mandrel. The forward end portion 23 of the mandrel extends beyond the bridge sleeve assembly.

The bridge sleeve assembly includes a tubular sleeve 25 and a clamp mechanism 26 at each end of the sleeve. The sleeve 25 includes cylindrical inner and outer surfaces 27 and 28 and a pair of ends 29 and 30 (see also FIGS. 3 and 6–8).

Figure 11:
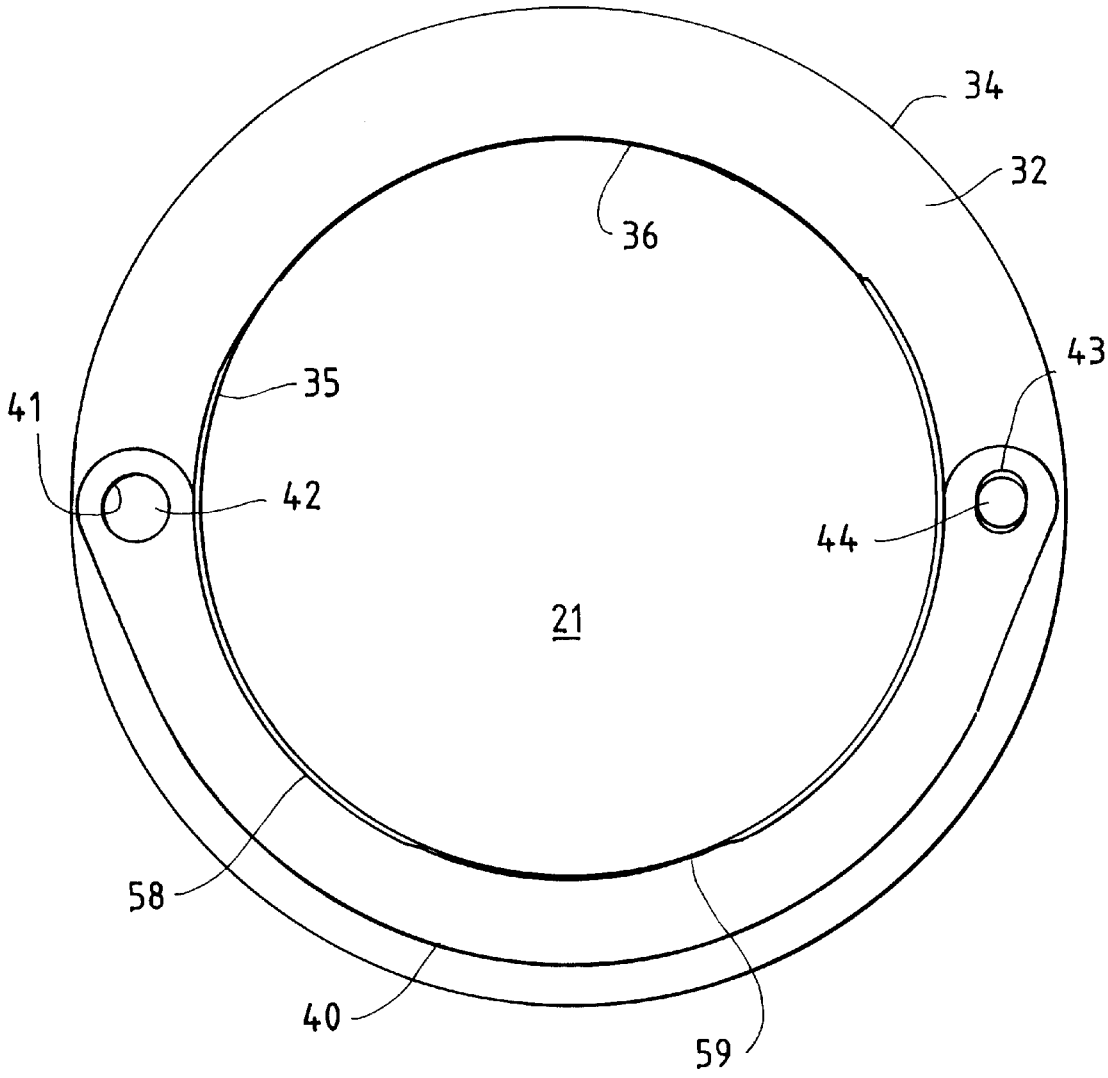
FIG. 11 is an end view corresponding to FIG. 4 showing the ring and clamping arm on one end of the bridge sleeve assembly with the eccentric in an open position.
Figure 12:
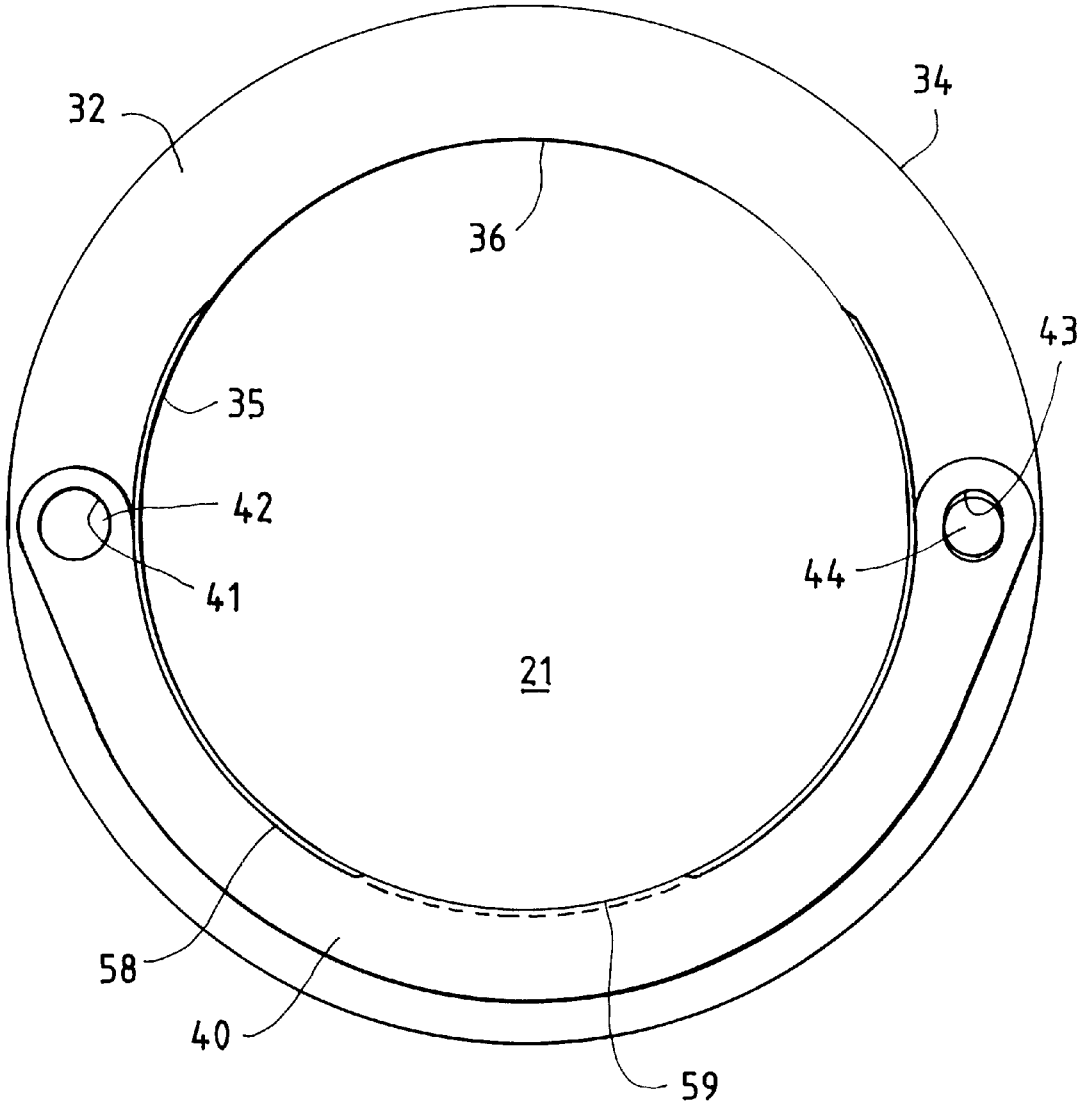
FIG. 12 is a view similar to FIG. 11 showing the eccentric in a closed position so that the mandrel is clamped between the ring and the clamp arm.
Figure 13:
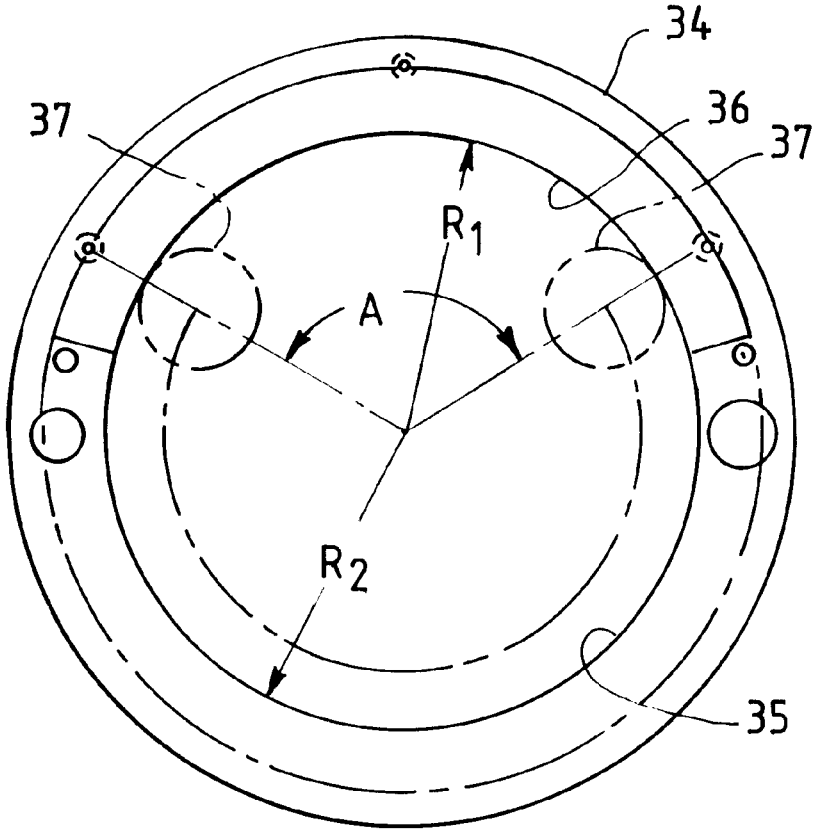
FIG. 13 is an end view of one of the rings.

The clamp mechanism 26 includes a pair of rigid rings 32 and 33 which are mounted inside of the sleeve 25 adjacent the ends of the sleeve. Referring to FIGS. 11–13, each of the rings includes a cylindrical outer surface 34 which abuts the inner surface of the sleeve and a generally cylindrical inner surface 35. The inner surface of the ring includes a radially inwardly extending or raised precision contact portion 36 which concentrically locates on the precision outer surface of the mandrel when the clamping mechanism is actuated. In FIG. 13 the contact portion 36 extends along the arc defined by the angle A. The ends of the contact portion are radiused as indicated by the circles 37. The contact portion has a radius $R_1$ which is less than the radius $R_2$ of the remainder of the inside surface of the ring.

Figure 6:
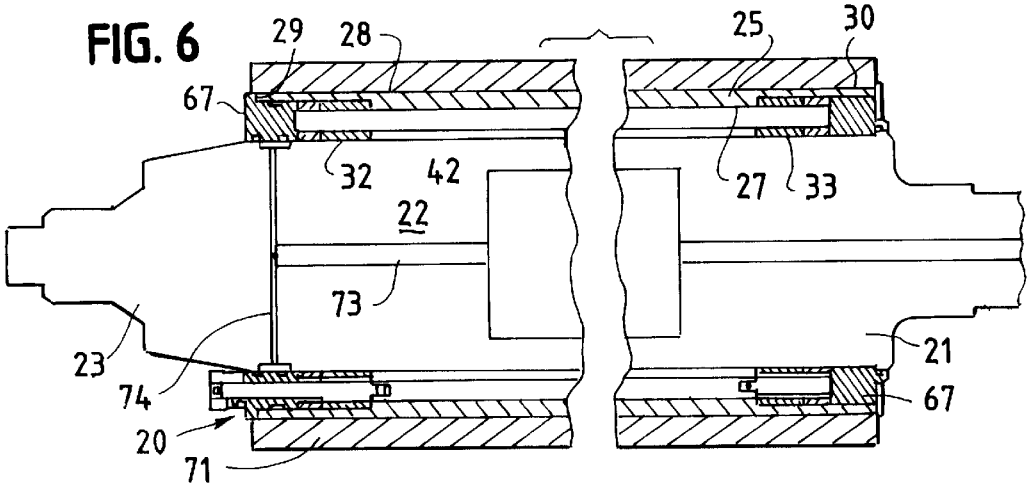
FIG. 6 is a longitudinal sectional view, partially broken away, taken along the line 6—6 of FIG. 5.
Figure 8:
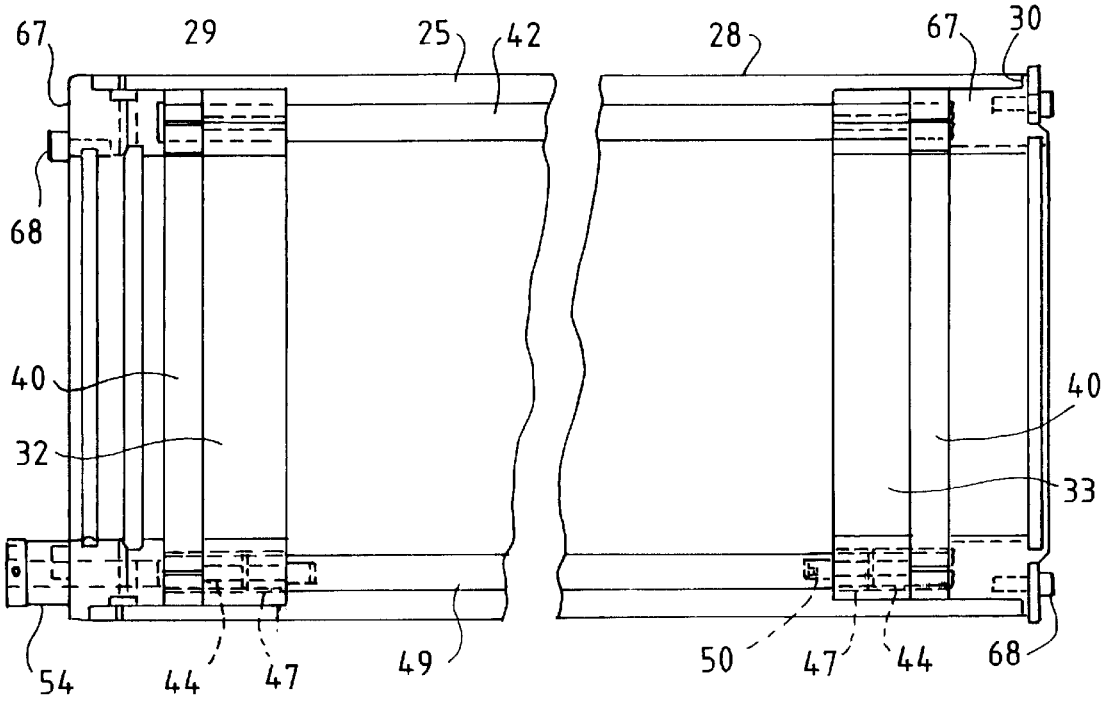
FIG. 8 is a longitudinal sectional view, partially broken away, of the bridge sleeve assembly.
Figure 16:
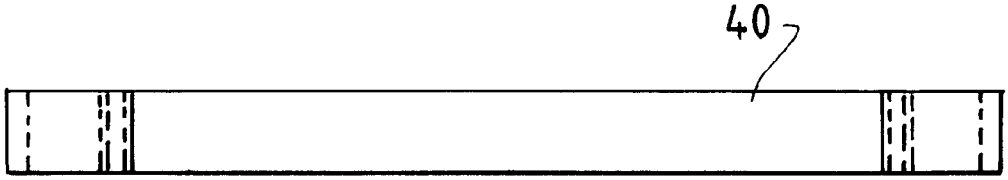
FIG. 16 is a top view of the clamp arm of FIG. 15.

A curved clamp arm 40 (see also FIGS. 15 and 16) is pivotally mounted on the outboard end of each of the rings 32 and 33. One end of each clamp arm is provided with an opening 41, and a pivot shaft 42 extends through the opening 41. The other end of the clamp arm is provided with an opening 43, and an eccentric shaft 44 extends through the opening 43. Referring to FIGS. 6 and 8, the pivot shaft 42 advantageously extends through the rings 32 and 33 and the clamp arms 40 at both ends of the bridge sleeve. Either the pivot shaft can be rotatably mounted in the rings, or the clamp arms can be rotatably mounted on the shaft, so that the clamp arms can pivot with respect to the rings.

Figure 9:
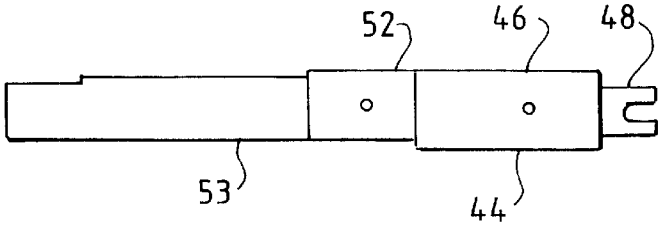
FIG. 9 is a side view of one of the eccentric shafts.
Figure 10:
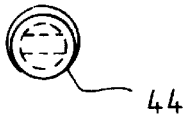
FIG. 10 is a end view of the eccentric shaft of FIG. 9.

Referring to FIGS. 8 and 9, each eccentric shaft 44 includes a cylindrical portion 46 which is rotatably mounted within each of the rings 32 and 33 by needle bearings 47. The inboard end of each eccentric shaft terminates in a fork 48 (FIG. 9). A cross shaft 49 (FIG. 8) extends between the forked ends of the two eccentric shafts, and a cross pin 50 on each end of the shaft engages the fork so that both eccentric shafts rotate together.

An eccentric or camming portion 52 of the eccentric shaft extends forwardly from the cylindrical portion 46 and is positioned within the opening 43 of the clamp arm. The eccentric shaft for the ring 32 includes a cylindrical forward end portion 53 which extends forwardly from the camming portion. A knob 54 (FIGS. 1, 4, and 8) and a lever arm 55 is mounted on the forward end portion for facilitating rotation of the eccentric shaft.

Figure 15:
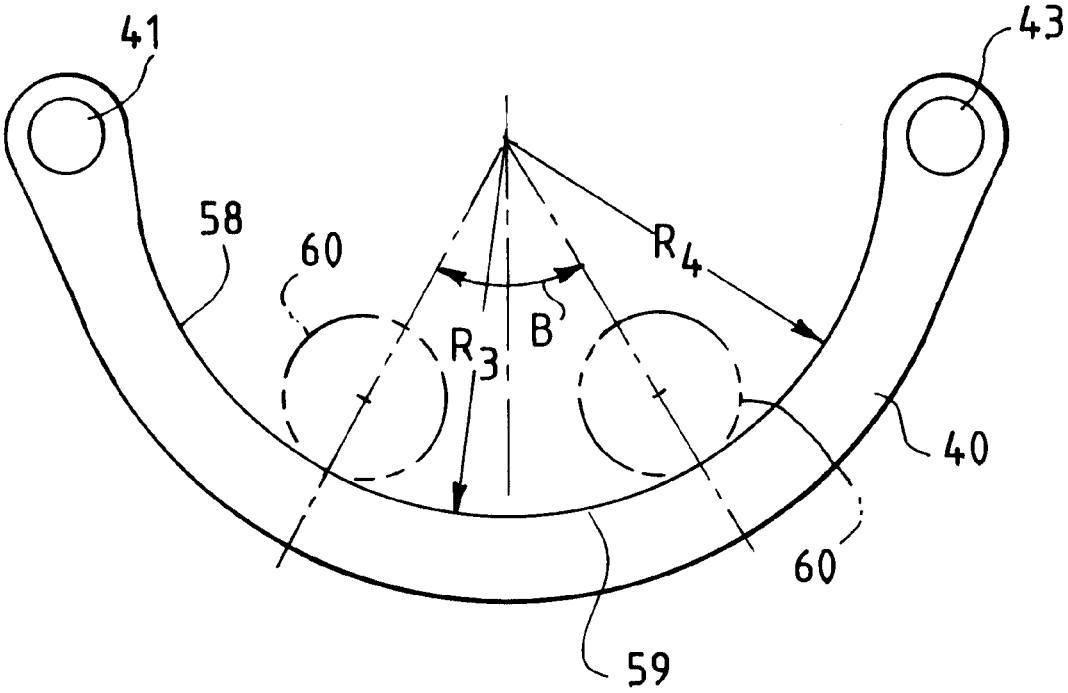
FIG. 15 is an end view of one of the clamp arms.

Referring to FIGS. 11, 12, 15, and 16, each clamp arm 40 includes a curved inside surface 58 which includes a radially inwardly extending or raised contact portion 59 which engages the outer surface of the mandrel when the clamping mechanism is actuated. In FIG. 15 the contact portion extends along the arc defined by the angle B. The ends of the contact portion are radiused as indicated by the circles 60. The contact portion has a radius $R_3$ which is less than the radius $R_4$ of the remainder of the inside surface 58.

In FIG. 11 the eccentric shaft 44 is positioned so that the clamp arm 40 is spaced from the bottom of the mandrel. The dimension of the spacing is exaggerated for clarity of illustration. The space between the eccentric shaft 44 and the inside surface of the opening 43 is also exaggerated. When the clamp arm 40 is in its FIG. 11 or open position, the sleeve assembly can easily be inserted over or removed from the mandrel.

When the eccentric shaft is rotated from its FIG. 11 position to its FIG. 12 or clamping position, the eccentric shaft cams the opening 43 of the clamp arm upwardly and forces the contact portion 59 of the clamp arm into engagement with the bottom of the mandrel so that the mandrel is firmly clamped between the contact portion 59 of the clamp arm and the precision contact portion 36 of the ring 32. The clamping mechanism clamps the mandrel with a repeatable preload.

Figure 3:
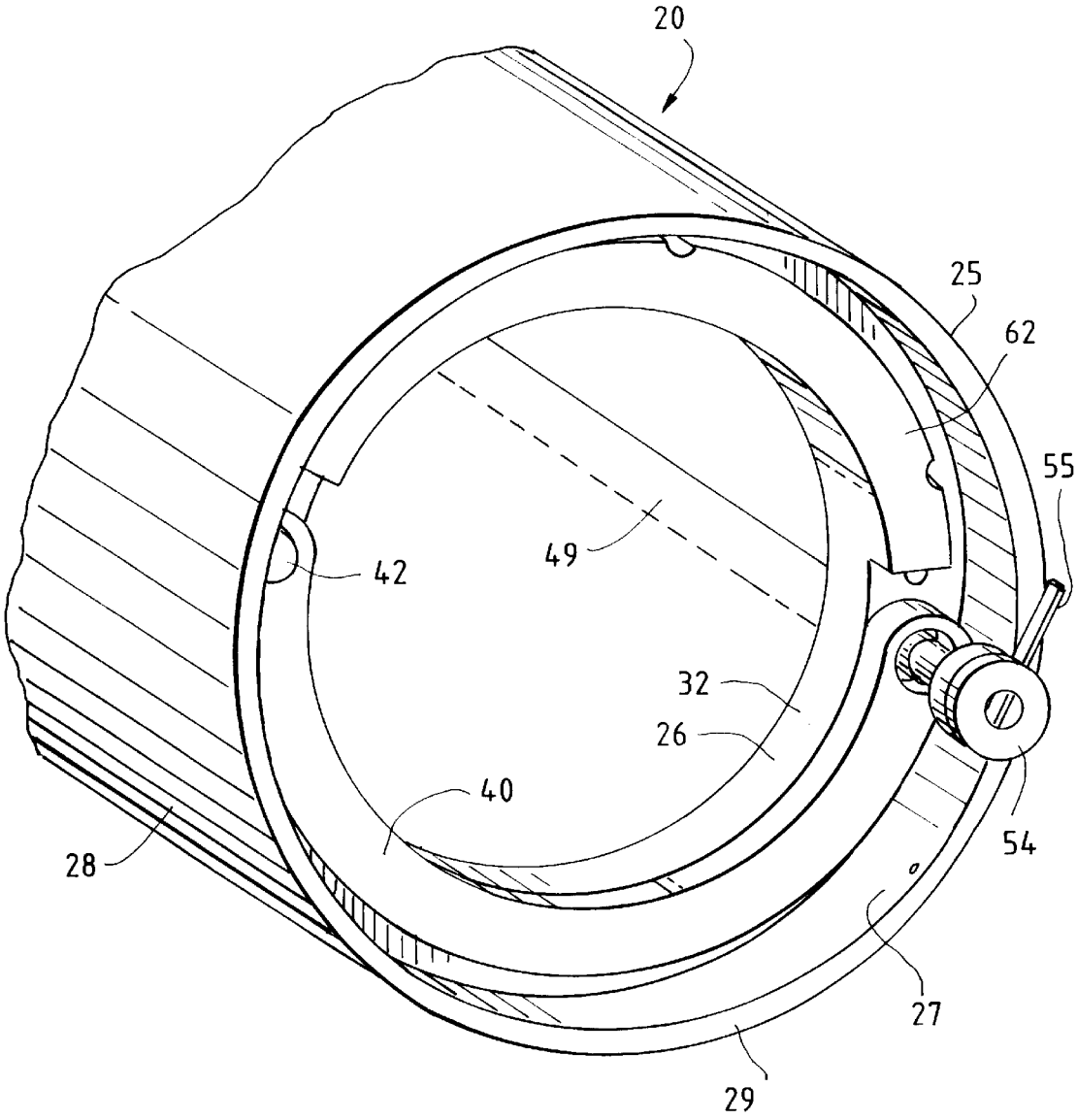
FIG. 3 is a fragmentary perspective view of one end of the bridge sleeve assembly.
Figure 4:
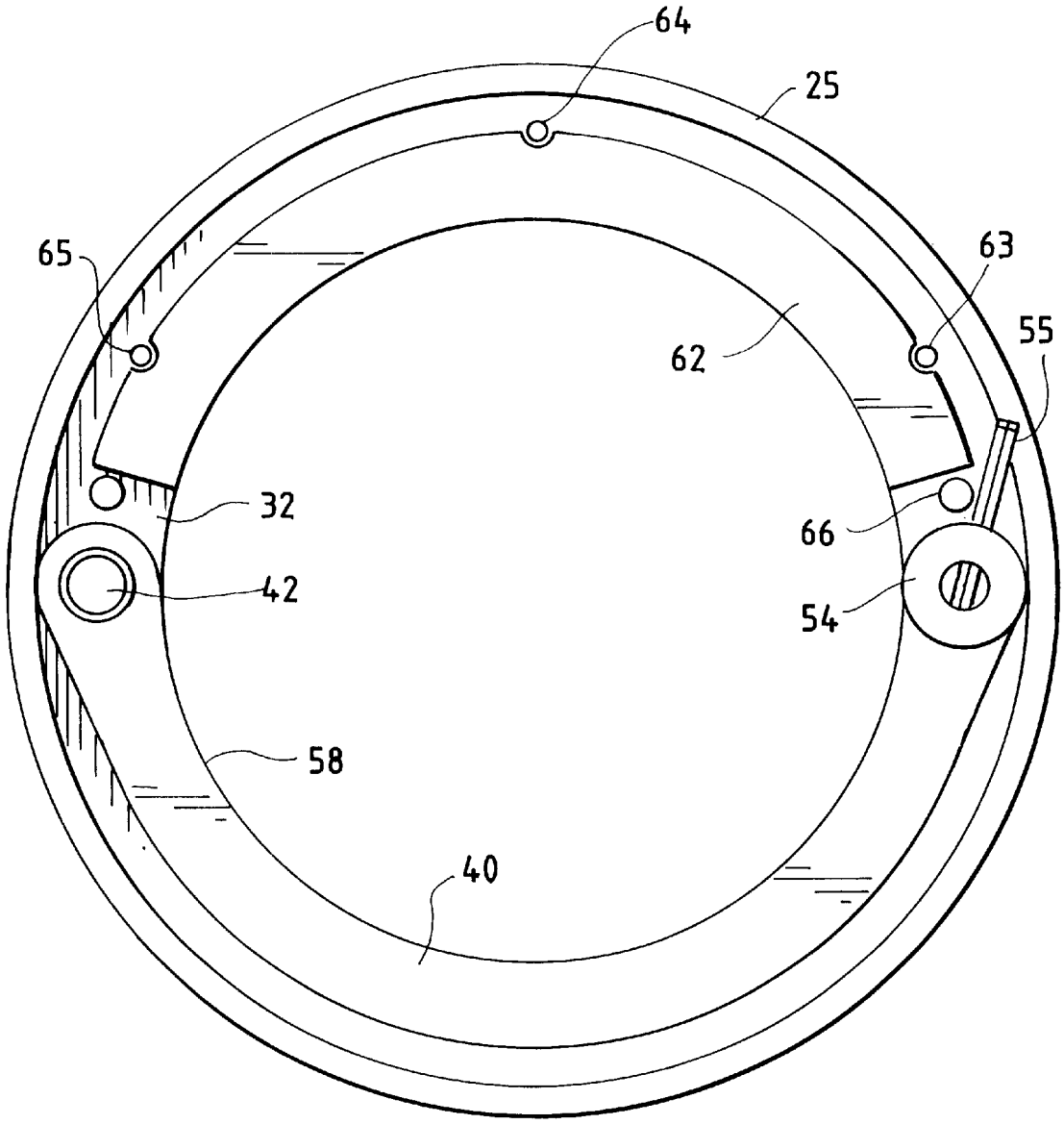
FIG. 4 is an end view of the bridge sleeve assembly.
Figure 14:
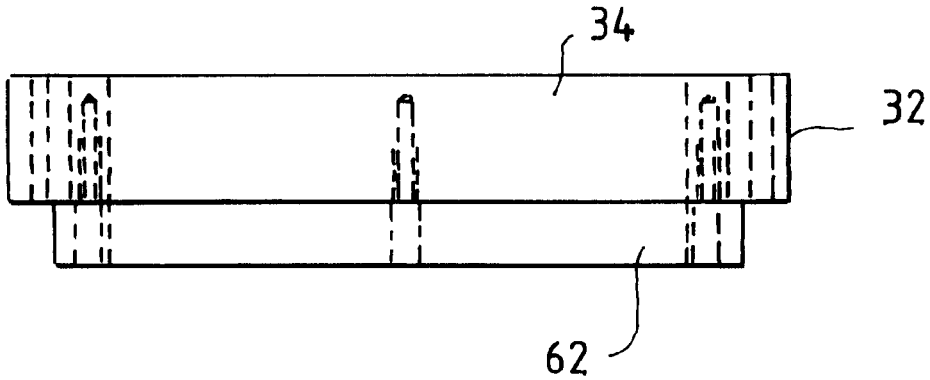
FIG. 14 is a top view of the ring of FIG. 13.

Referring to FIGS. 3, 4, and 14, each of the rings 32 and 33 includes an upper portion 62 above the clamp arm which extends for substantially the same axial extent as the clamp arm. The upper portion 62 provides a counterweight for the clamp arm so that the system is balanced in the clamp position. Each ring is provided with threaded openings 63, 64, and 65 above the counterweight and openings 66 below the counterweight. The holes 66 permit air to pass through the ring axially.

Figure 5:
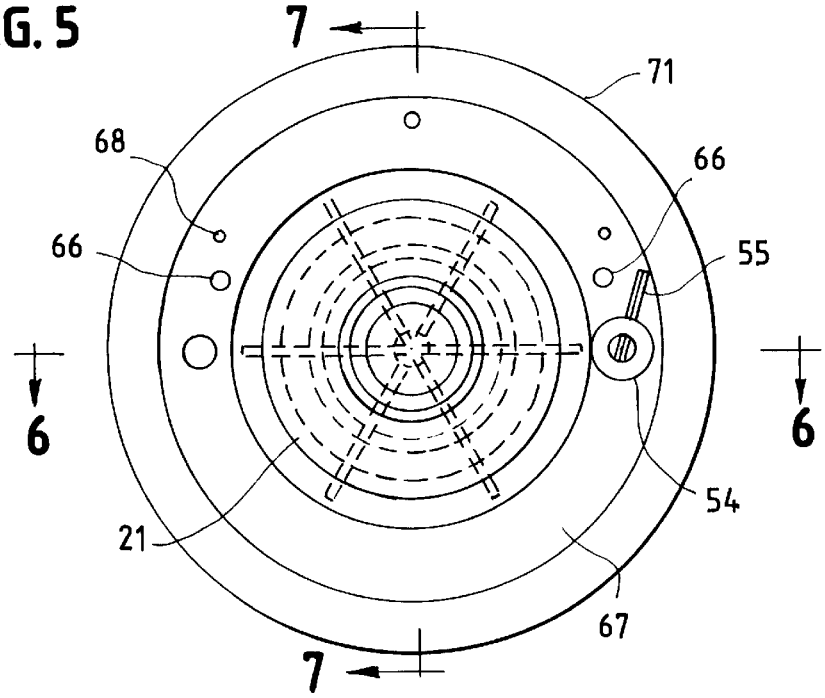
FIG. 5 is an end view of the bridge sleeve assembly, mandrel, and a print sleeve.

A light weight header 67 (FIGS. 2, 5, and 8) is secured to each end of the bridge sleeve by bolts 68 which are screwed into the openings 63–65 in the rings 32 and 33. The eccentric shaft 44 extends through the forward header 67. A stop pin, not illustrated, is mounted in the light weight header 67. It extends into an annular groove in the knob 54 to limit rotational travel of the eccentric.

FIGS. 5–8 illustrate a conventional cylindrical print sleeve 71 mounted on the outside surface of the bridge sleeve 25. As is well known in the art, a printing plate can be mounted on the print sleeve. The print sleeve has a soft interior layer which provides interference with the bridge sleeve. The interference is needed to secure the print-sleeve to the bridge sleeve. In order to release the print sleeve, air is ported between the print sleeve and the bridge sleeve to compress the print sleeve inner features to make them larger and to permit the print sleeve to be installed and removed from the bridge sleeve. For print repeats which are too small to use a bridge sleeve, air ports and controls in the press mandrel can float the smaller print sleeves. For print repeats that can take advantage of bridge sleeves, air is passed through the mechanical bridge sleeve to float the print sleeves.

Figure 7:
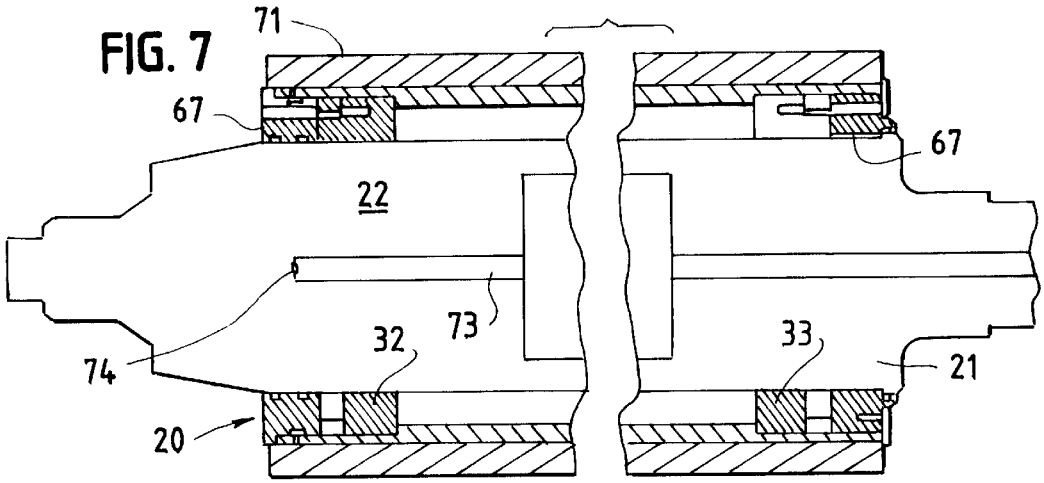
FIG. 7 is a longitudinal sectional view, partially broken away, taken along the line 7—7 of FIG. 5.

FIGS. 6 and 7 illustrate a conventional axial air passage 73 in the mandrel and radial air passages 74. The header 67 at the forward end of the bridge sleeve is aligned with the radial passages 74 and is provided with O-rings to seal the air. As is well known in the art, the headers are provided with passages to port air from the radial passages 74 to the print sleeve to float the print sleeve for installation and removal.

When manufacturing the bridge sleeve assembly with the clamp system, the final machining operation on the outside of the bridge sleeve is done with the clamps secured on a machining mandrel. That machining mandrel is the same size as the mandrel on which the sleeve will be mounted when in use. Since all mandrels have only a small permitted size variation, sleeve distortion from the clamp action when being machined will be the same as when it is used. As a result, the installed sleeve will be as cylindrical as it was when it was machined.

The invention includes the following novel features:

1. The mechanical clamp action does not require external hydraulic or pneumatic actuation to either release or impose clamp forces.
2. The mechanical advantage of the small eccentric with the additional mechanical advantage of pulling on one end of the arm, while resisting in roughly the middle of the arm, permits a tool free design.
3. The clamps on both ends of the bridge sleeve can be clamped and released at one time from one end.
4. Existing pneumatic control systems on standard press mandrels can pass air pressure through the bridge sleeve to secure and release print sleeves with no press or print sleeve modifications or control system changes.
5. There is no need for notches and pins on the press mandrel, bridge sleeve, or print sleeve. All can be adequately aligned with visual alignment of alignment marks.
6. The design permits a rigid mounting of the bridge sleeve on the press mandrel because there is no compressible layer.
7. The shell is a rigid outer member that gives the bridge sleeve high bending rigidity. This is an important factor in reaching good print quality. Depending on the needs of the end user, the shell can be sized and the material can be selected to meet rigidity requirements. Materials can include conventional materials, like aluminum and steel or composite materials like carbon fiber composite in order to meet bending and weight targets.
8. The rigid ring on each end of the shell is the primary attachment of the shell to the mandrel. It provides direct contact on one side and general rigidity to the shell ends. The pivot and eccentric for the clamp arm mount to the ring. A fixed contact area on the ring acts like two of the three points needed to precisely establish the location of the ring relative to the mandrel. The third point on the clamp arm creates clamp force with consistent distortion. A block opposite the arm acts as a counterweight to balance the system.
9. The clamp arm mounts to a pivot on the rigid ring and to an eccentric mounted to the pivot ring. The clamp arm has a raised contact area to mate with the mandrel when the eccentric is in the clamped position. When the clamp arm is flexed because of the eccentric pulling the arm against the mandrel, the spring rate of the clamp preload suffices to hold the rigid ring firmly against the mandrel during all running conditions, but is soft enough to permit turning the eccentric by hand.
10. An eccentric with a relatively small offset is mounted in the rigid ring with the eccentric driving a small motion on the arm. As a non-essential part of the design, both the mounting features for the eccentric and the attachment point to the arm are mounted in needle bearings. A second eccentric on the opposite end is connected by a cross rod so that both ends can be actuated at the same time from only one end of the bridge sleeve. The eccentric size is driven in part by the need to swing the arm out for a generous assembly clearance.
11. A knob with clamp handle is attached to the eccentric. It has a mechanical stop to limit travel and to insure that the rotation direction is logical.

The hardware for this invention can be from any competent standard manufacturing source. There are no unique parts that require a preferred manufacturer.

When installing and removing the bridge sleeve, the bridge sleeve rests on the press mandrel on the relatively rigid fixed contact portions of the rings 32 and 33 and the clamp arms 40. In the preferred embodiment there is a clamp system on each end of the bridge sleeve. Additional clamp systems could be added, if needed. The eccentric cam is connected to a shaft that extends for the full length of the press. This permits actuation of the front clamp and back clamp at the same time. Primarily for balance reasons, the pivot point is made from a rod that runs the full length of the bridge sleeve and is the same size as the eccentric cam rod.

The mounting headers for the bridge sleeve are advantageously made from continuous steel rings or other rigid material. Each ring has a cutout for the clamp arm. This gives good rigidity and counterbalance to the clamp arm. External headers made from plastic or other convenient material are used to guide the inflation air from the press mandrel to the outer sleeve and to act as an external sleeve stop on the back end. The eccentric cam is turned with a knob with a pin through it for leverage. It has a pin stop to limit rotation travel.

In the preferred embodiment the rings 32 and 33 and the clamp arms 40 are made from steel. Even though steel is normally thought of as rigid and noncompliant, steel does have enough spring action and compliance to permit the clamp arm to engage and clamp the mandrel and to permit the eccentric to move to an over center self-locking position just before the lever arm engages the stop pin.

The clamping arm and header ring are designed with these goals:

1. have enough arm contact force so that the steel header ring will always have good contact with the mandrel under all running conditions;
2. have enough drive torque at the contact points so that the bridge sleeve will not slip on the mandrel;
3. insure that the clamp arm will have adequate clearance around the mandrel when it is unclamped so that the bridge sleeve can easily be assembled to and removed from the mandrel;,
4. keep the locking knob torque low enough so that it can be actuated by hand;
5. keep the stresses low enough in all of the components to insure long, reliable life.

Actual design work is done using computational tools and techniques that are familiar to those who are skilled in the art of machine design and analysis. Specific geometry and materials for the clamp arm and header ring are selected to meet the five goals. After calculating the spring rate in all deflection modes, calculate the forces on the eccentric and the mandrel in all extreme eccentric positions cases and the clearance between the clamp arm and the mandrel in the open case. Convert these forces to torque on the knob and compare the forces and the torque to the window of acceptable performance. Adjust the geometry or material as needed to get acceptable performance.

The raised contact pads on the steel headers and the clamp arms define the location of the bridge sleeve relative to the press mandrel. Their exact size is not generally critical, but they are sized to provide the equivalent of a three-point contact. In the ideal three point contact case, the points would be 120 degrees apart. The wide contact on each of the steel headers 32 and 33 is the equivalent of two points in the three point model. If the ends were spread much farther apart, i.e., closer to 180 degrees, the raised features would get in the way of easily installing and removing the bridge sleeve from the press mandrel. If the ends were much closer together, the pad would not be effective as two points of contact. Pad size on the clamp arm is a comfortable trade off between ease of manufacturing and minimizing contact stress and becoming so wide that it gets in the way of easy installation and removal of the bridge sleeve on the press mandrel.

In the preferred-embodiment the bridge sleeve is formed from carbon fiber composite material. After the carbon fiber bridge sleeve is fully assembled, it is clamped onto a machining mandrel, and the outside is ground cylindrical and to the right diameter. This operation effectively machines away any distortion from the clamp action. When the sleeve is used on a press mandrel with the same diameter and the clamp is tightened in the same way, the bridge sleeve will return to its machined cylindrical shape.

While in the foregoing specification a detailed description of specific embodiments were set forth for the purpose of illustration, it will be understood that many of the details herein given may be varied considerably by those skilled in the art without departing from the spirit and scope of the invention.

We claim:

1. A sleeve assembly adapted to be mounted on a mandrel comprising:

a tubular sleeve having a pair of ends and inner and outer surfaces, a ring secured to the inner surface of the sleeve adjacent one end thereof, the ring having an inside surface with a contact portion which is adapted to locate a cylindrical mandrel extending through the ring, a clamp arm movably mounted on the ring, the clamp arm having a contact portion which is spaced from the contact portion of the ring and which is adapted to engage a mandrel extending through the ring, the clamp arm being movably mounted on the ring so that the contact portion of the clamp arm is movable toward the contact portion of the ring whereby a mandrel can be clamped with repeatable preload between the contact portions of the ring and the clamp arm.

2. The assembly of claim 1 in which the clamp arm is curved and includes first and second ends, the first end being pivotally secured to the ring and the second end being movably mounted on the ring.

3. The assembly of claim 2 in which the second end of the clamp arm is provided with an opening having an inside surface, and an eccentric shaft rotatably mounted in the ring and extending through the opening in the second end of the clamp arm, the eccentric shaft having an eccentric surface which is engageable with the inside surface of the opening for moving the contact portion of the clamp arm toward and away from the contact portion of the ring.

4. The assembly of claim 1 in which the ring and clamp arm are formed from steel.

5. The assembly of claim 4 in which the sleeve is formed from composite material.

6. The assembly of claim 1 in which the sleeve is formed from composite material.

7. The assembly of claim 1 in which the contact portion of the ring is curved and extends for less than 180 degrees around the inside surface of the ring.

8. The assembly of claim 1 in which the clamp arm is movable between a first position in which the contact portion of the clamp arm is spaced from the mandrel and a second position in which the contact portion of the clamp arm and the contact portion of the ring engage the mandrel.

9. The assembly of claim 1 including a second ring secured to the inner surface of the sleeve adjacent the other end thereof, the second ring having an inside surface with a contact portion which is adapted to engage a mandrel extending through the ring, and a second clamp arm movably mounted on the second ring, the second clamp arm having a contact portion which is spaced from the contact portion of the second ring and which is adapted to engage a mandrel extending through the ring, the second clamp arm being movably mounted on the second ring so that the contact portion of the second clamp arm is movable toward the contact portion of the second ring whereby a mandrel can be clamped between the contact portions of the second ring and the second clamp arm.

10. The assembly of claim 9 in which the second clamp arm is curved and includes first and second ends, the first end of the second clamp arm being pivotally secured to the second ring, the second end of the second clamp arm being provided with an opening having an inside surface, a second eccentric shaft rotatably mounted in the second ring and extending through the opening in the second end of the second clamp arm, the second eccentric shaft having an eccentric surface which is engageable with the inside surface of the opening in the second clamp arm for moving the contact portion of the second clamp arm toward and away from the contact portion of the second ring, and a shaft connecting the first-mentioned eccentric shaft and the second eccentric shaft.

11. The assembly of claim 10 including a pivot shaft extending between and through the first-mentioned ring and the second ring, the first and second clamps being mounted on the pivot shaft.

* * * * *